United States Patent [19]

Wetmore et al.

[11] 4,176,722

[45] Dec. 4, 1979

[54] MARINE RISER SYSTEM WITH DUAL PURPOSE LIFT AND HEAVE COMPENSATOR MECHANISM

[75] Inventors: Sherman B. Wetmore, Westminster; James F. McNary, Santa Ana; Abraham Person, Los Alamitos, all of Calif.

[73] Assignee: Global Marine, Inc., Los Angeles, Calif.

[21] Appl. No.: 886,903

[22] Filed: Mar. 15, 1978

[51] Int. Cl.[2] ..... E21B 7/12

[52] U.S. Cl. ..... 175/7; 175/27; 166/355

[58] Field of Search ..... 175/5, 7, 27; 166/367, 166/368, 352, 355; 114/256, 24; 214/1 P, 2.5; 267/125; 254/172, 173 R

[56] References Cited

U.S. PATENT DOCUMENTS

| | | | |
|---|---|---|---|
| 3,421,581 | 9/1969 | Van Geijn | 175/27 X |
| 3,785,445 | 1/1974 | Scozzafava | 175/27 |
| 3,939,991 | 2/1976 | Person | 214/1 P |
| 3,943,868 | 3/1976 | Person et al. | 175/27 X |
| 3,946,559 | 3/1976 | Stevenson | 254/172 |
| 4,004,532 | 1/1977 | Reynolds | 175/5 |

*Primary Examiner*—James A. Leppink
*Assistant Examiner*—Richard E. Favreau
*Attorney, Agent, or Firm*—Christie, Parker & Hale

[57] ABSTRACT

Apparatus for drilling a well at a location submerged below a body of water includes a buoyant foundation structure. The foundation structure is floatable on the surface of the body of water and is subject to vertical motion in response to waves and the like. A riser handling and tensioning mechanism is mounted to the foundation structure and is operable for moving a riser pipe along a substantially vertical line from and to the foundation into and out of connection with the submerged location. The riser handling and tensioning mechanism is also operable for applying tension to a riser pipe connected to the submerged location. The handling and tensioning mechanism includes vertically disposed hydraulic rams mounted to the foundation structure. Holding means are releasably engageable with a riser pipe adjacent its upper end and are connected to the rams for movement along the riser line by the rams. The rams have an active operating mode in which they are operable to lower and raise a riser pipe along the line into and out of connection of the lower end of the riser with the submerged location. The rams also have a passive operating mode in which they are operable to apply a selected upward force to a riser engaged in the holding means and connected to the submerged location during vertical motion of the foundation structure.

18 Claims, 4 Drawing Figures

3
21
42
32
53
53
41
41
42
20
29
25
28
10
23
27
60
38
43
3
35
40
43
22
36
44
39
16
34
30

MARINE RISER SYSTEM WITH DUAL PURPOSE LIFT AND HEAVE COMPENSATOR MECHANISM

FIELD OF THE INVENTION

This invention pertains to oil and gas drilling from floating structures. More particularly, it pertains to apparatus for handling and for tensioning marine drilling risers in deep water drilling operations.

BACKGROUND OF THE INVENTION

The Problems of Deep Water Oil and Gas Drilling

The techniques of drilling for subsea reserves of oil and gas from floating vessels, as well as from non-floating offshore platforms, are well known. In the context of this invention, drilling operations performed on a non-floating platform erected on the ocean floor are analogous to oil and gas drilling operations performed on land, and such operations do not present the problem with which this invention is concerned. The problem to which this invention is addressed is currently encountered in the context of subsea drilling operations performed from floating structures; the floating structures may be either drillships of shipform nature or that class of floating structure known as semi-submersible drilling platforms. The problem is presented by the riser pipe which is connected between the subsea wellhead and the floating drilling platform to provide a return path for drilling mud to the platform from the subsea well.

In oil and gas drilling operations, whether performed on land or at sea, a water-based mineral slurry of controllable density is used to cause the hydrostatic pressure in the well being drilled to approximate, as closely as possible, the probable pressure of gas or oil in the subterranean formation being drilled. This slurry is called "drilling mud". By regulation of the density of the drilling mud in combination with the height of the column of the drilling mud in the well being drilled, a measure of control is obtained over the well to prevent blowouts. Blowouts can occur when the drill bit breaks into a formation where oil or gas exists under pressure. If no hydrostatic safety mechanism were provided in the well bore, emergence of the drill bit into a pressurized subterranean formation would result in the oil or gas in the formation "blowing out" through the bore and either destroying or presenting substantial hazard to the drilling platform and its personnel. Accordingly, drilling mud is used in connection with mechanisms known as blowout preventers either to prevent the occurrence of a blowout or to slow occurrence of a blowout until the blowout preventer mechanisms associated with the wellhead, either on land or at the ocean floor, can be operated to shut in the well and prevent the emergence of the highly pressurized oil or gas from the well bore.

Drilling mud is expensive. It is desirable that the drilling mud be returned from the well bore to the drilling platform so that it can be cleaned, processed and reused. Also, the contents of the drilling mud, as returned to the drilling platform, are informative about the formation being drilled at the time. The contents of the drilling mud, as analyzed at the drilling platform, can, among other things, give warning that a high pressure oil or gas pocket is being approached by the drill bit, and that the density of the drilling mud should be adjusted or other steps taken to control the well and prevent a blowout. Thus, from considerations of both economics and safety, it is desirable that the drilling mud be returned to the drilling platform.

In current typical offshore drilling operations, drilling mud is returned from the well bore to the drilling platform through a pipe extending from the submerged wellhead blowout preventer to the drilling platform substantially concentrically about the drill string. This pipe is known as the "riser pipe", or "riser", and is of large diameter relative to the drill string. Because of its large diameter, the riser is subjected to high levels of bending stress in response to lateral loading by ocean currents and the like. The riser pipe is made with relatively thick walls to enable it to withstand these bending stresses; this causes the riser assembly to be heavy. In order to maintain substantial concentricity of the riser relative to the drill string and to prevent the riser from buckling under its own weight, the riser is maintained under tension along its length by a tensioning mechanism located, usually, at the drilling platform. Typically, the riser tensioning mechanism is provided by a plurality of wire rope cables connected between the upper end of the riser and the platform. If the platform is a floating platform, constant tension devices are needed in this connection because the drilling platform moves vertically, as well as laterally, in response to wave and tidal action. Also, because of the presence of vertical motion of the platform relative to the upper end of the riser, current practice provides a telescoping slip joint in the riser. Usually the slip joint is at the upper end of the riser, and the duct for flow of the drilling mud from the riser to the drilling mud processing facility is connected to the riser via this slip joint.

For many years, the maximum depth of water in which offshore wells could be drilled from floating platforms was on the order of 300 feet due to the limitations of mooring systems for the floating platforms. This depth limitation has been expanded by improvements in mooring systems and by the development of dynamically positioned floating drilling platforms which require no mooring to the ocean floor. The rule-of-thumb maximum water depth in which offshore wells now may be drilled is on the order of 1000 feet, and this limitation is set by factors attendant to the riser. Conventional riser systems and riser tensioning arrangements can be used, albeit with some difficulty, in water depths up to, but not much beyond, about 1000 feet. One thousand feet appears to be a practical limit beyond which strengthened riser pipes and riser tensioning mechanisms of conventional configuration cannot be used economically. As a result, considerable thought has been applied in the offshore drilling industry to the development of wholly new riser systems and of riserless drilling systems.

It is useful to note that the bending moments which are developed in a beam are proportional to the cube (third power) of the length of the beam; this relation is modified somewhat if the beam is placed in tension along its length. Forces applied to a riser by ocean currents act on the riser in much the same way as vertical loads act on a horizontal beam. Thus, assuming constant loading conditions on risers of the same transverse size, a 600-foot riser would deflect roughly eight times as much as a 300-foot riser and would develop eight times the stress. However, it is desirable to keep the riser concentric to the drill string and to keep the drill string straight. Therefore, as risers become longer, it is necessary to make them more resistant to lateral deflection, and this in turn results in heavier and larger diameter risers which are more and more difficult to store, assemble, handle and adequately tension. Axial tensioning of risers is another problem separate from lateral bending.

Some deep water riser systems now in use create tension in the risers by attaching buoyant members to the outer circumference of the riser at various locations along the vertical extent of the riser; this technique has been used in risers up to 3000 feet long. A practical difficulty with this approach is that the buoyant members enlarge the silhouette of the already large riser and render the riser substantially more susceptible to lateral loads due to drage forces created by ocean currents. Also, buoyancy members are bulky and are difficult to store aboard the drilling platform prior to installation of the riser. Buoyancy members are difficult to connect to the riser, and their presence on the riser considerably complicates installation of the riser between the submerged wellhead and the drilling platform. Perhaps most significantly, buoyancy members are very expensive; their cost ranges from 5 to 10 Dollars per pound of buoyancy. Riserless drilling systems are subject to criticism because they may not provide a return path for the drilling mud to the drilling platform, thereby creating problems of economics and safety, as shown above.

Wire rope riser tensioning systems require periodic replacement of the riser tensioning cables. Safety considerations require that a wire rope cable be replaced after it has been used a specified time under specified load conditions. The greater the load to which the wire rope is subjected, and/or the more times it cycles back and forth across its supporting sheaves, the more frequently the wire rope should be replaced. As wire rope riser tensioning systems are subjected to greater and greater loads due to their association with larger and longer risers, the frequency of riser cable replacement increases. In a typical wire rope riser tensioning system, it may take 6 to 8 hours to renew the cables; this operation is potentially hazardous and often requires that the drilling operations be suspended as this operation is being carried out. The daily charter rate for an offshore drilling rig is quite substantial, and interruptions in drilling operations are to be avoided wherever possible.

It is therefore seen that, for efficient and economic support of offshore drilling operations in deeper and deeper waters, a need exists for substantial improvements in the handling and tensioning arrangements for risers of very heavy but rather conventional design.

Review of the Prior Art

This invention involves the discovery and realization that certain of the mechanisms and systems provided on the *GLOMAR Explorer,* either directly or with modification, are very significantly useful in the context of deep ocean drilling operations and provide substantial benefits in coping with the problems described above. U.S. Pat. No. 3,919,958, for example, pertains to the *GLOMAR Explorer* as first built and refers to the vessel as a deep ocean mining ship; actually the *GLOMAR Explorer* was built for purposes other than deep ocean mining and other than deep water drilling activities. U.S. Pat. Nos. 3,918,379 and 3,939,991 pertain to other aspects of the *GLOMAR Explorer* which are meaningful to and can be used in the present invention.

SUMMARY OF THE INVENTION

The need identified above is addressed and solved by the present invention. A significant aspect of this invention is the recognition and discovery that equipment designed for other purposes, such as deep ocean mining or other deep ocean work, can be applied effectively to offshore drilling operations and, when so applied, provide substantial improvements in offshore drilling procedures and systems. This invention enables the elimination of riser slip joints in the connection between the upper end of the riser and the floating drilling platform. It permits the complete elimination of wire rope riser tensioning systems, and enables long riser pipes of heavy but relatively conventional design to be used effectively without reliance upon external buoyant riser attachments, thereby enabling the riser sections to be handled efficiently and expeditiously. Specifically, this invention involves the application to offshore drilling operations of the structures and mechanisms initially provided on the *GLOMAR Explorer* for deep ocean work, which structures and mechanisms are shown and described, for example, in U.S. Pat. Nos. 3,918,379, 3,919,958 and 3,939,991.

Generally speaking, this invention provides apparatus for drilling a well at a location submerged below a body of water. The apparatus comprises a buoyant foundation structure which is floatable on the surface of the body of water to be subject to vertical motion in response to waves and the like. Handling and tensioning means are provided for moving a riser pipe along a substantially vertical line from and to the foundation structure into and out of connection of the lower end of the riser with the submerged location. The handling and tensioning means are also operable for applying tension to a riser connected to the submerged location. The handling and tensioning means include vertically disposed hydraulic ram means mounted to the foundation structure. Holding means are releasably engageable with a riser adjacent the upper end thereof and are connected to the ram means for movement along said line in response to operation of the ram means. The ram means have separate active and passive operating modes. In its active operating mode, the ram means are operable to lower and raise a riser pipe along the vertical line into and out of connection of the lower end of the riser to the submerged location. In its passive operating mode, the ram means are operable to apply a selected upward force to a riser engaged by the holding means and connected to the submerged location during vertical motion of the foundation structure.

DESCRIPTION OF THE DRAWINGS

The above mentioned and other features of the present invention are more fully set forth in the following detailed description of a presently preferred embodiment of the invention, which description is presented with reference to the accompanying drawings, wherein.

DESCRIPTION OF THE ILLUSTRATED EMBODIMENT

Figure 1:
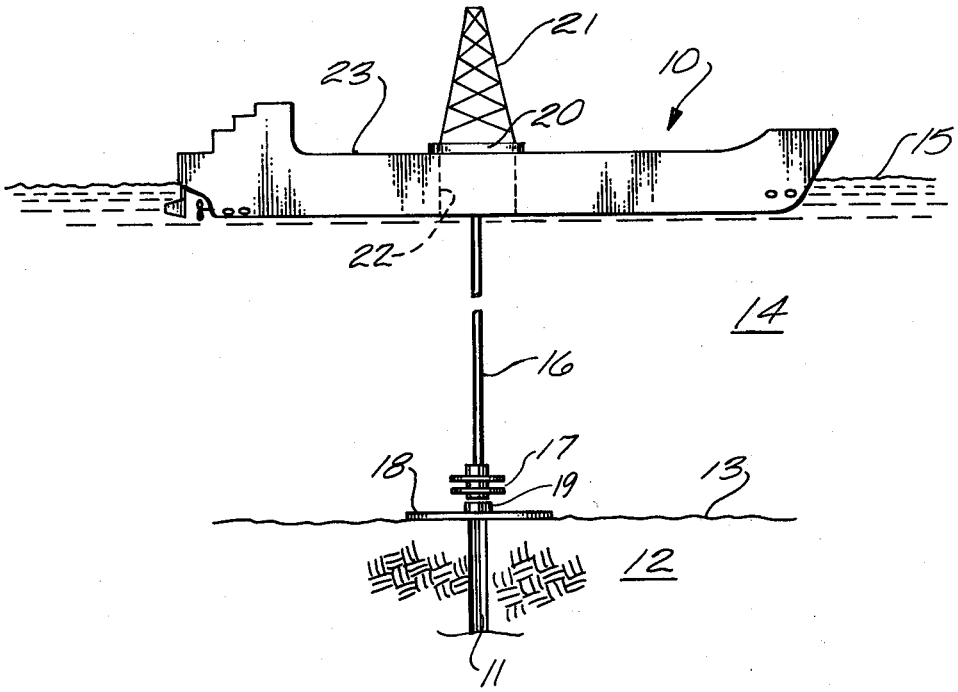
FIG. 1 is an elevation view showing a drill ship in use in the course of drilling a submerged well.

FIG. 1 shows a floating drilling structure, namely, a dynamically positionable drill ship 10, in use in the course of drilling an oil or gas well 11 in a geological formation 12 located below the bottom 13 of a sea or other body of water 14 having a surface 15 on which the drill ship is floating. Specifically, FIG. 1 shows the lowering of a large diameter elongate tubular riser 16 from the drill ship into cooperation with a wellhead assembly 19 supported upon ocean floor 13 by a suitable landing base 18 in alignment with the bore of well 11. The lower end of the riser carries a blowout preventer (BOP) 17; that is, the riser is used to lower the BOP into connection with the wellhead assembly.

At the stage of events illustrated in FIG. 1, the initial portions of well 11 have been drilled for a short distance into geological formation 12 in order that the subsea wellhead assembly, including landing base 18, may be installed. Riser 16 and BOP 17 are connected to the wellhead assembly to facilitate the flow of drilling mud and drill bit cuttings upwardly from the well bore within the riser tube around the exterior of an elongate drill string which is passed from the drill ship down through the riser and into the well bore. A suitable drill bit is carried by the lower end of the drill string; drilling mud flows downwardly from the drill ship into the well bore through the interior of the drill string.

Operations for the drilling of well 11 are carried out on drill ship 10, principally on a drilling platform 20 over which is erected a derrick 21. The drilling platform preferably is located over a central well 22 formed vertically through the drill ship from its main deck 23 to its keel.

Figure 2:
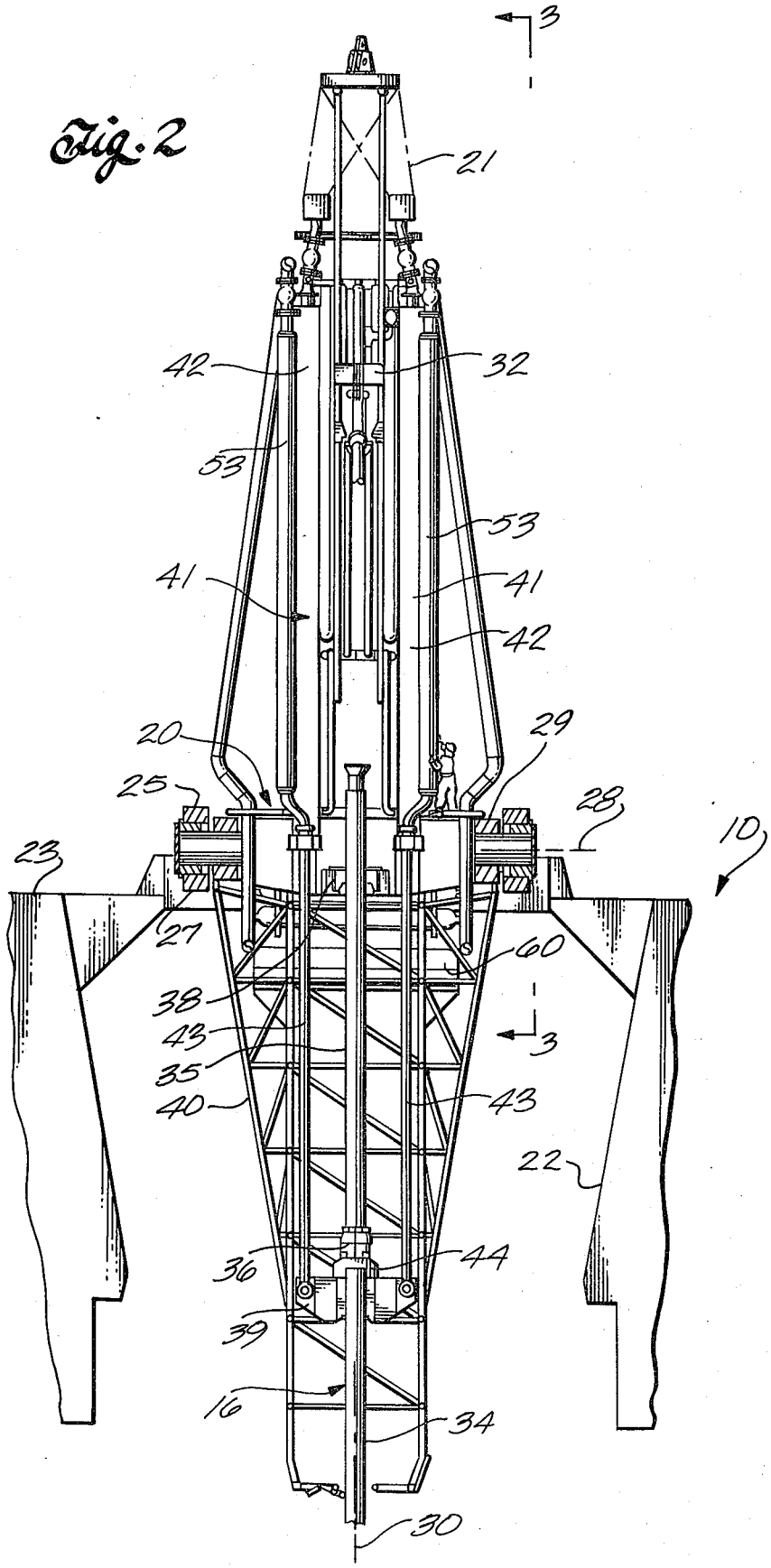
FIG. 2 is a fragmentary cross-sectional elevation view of a drilling platform on the drill ship shown in FIG. 1.
Figure 3:
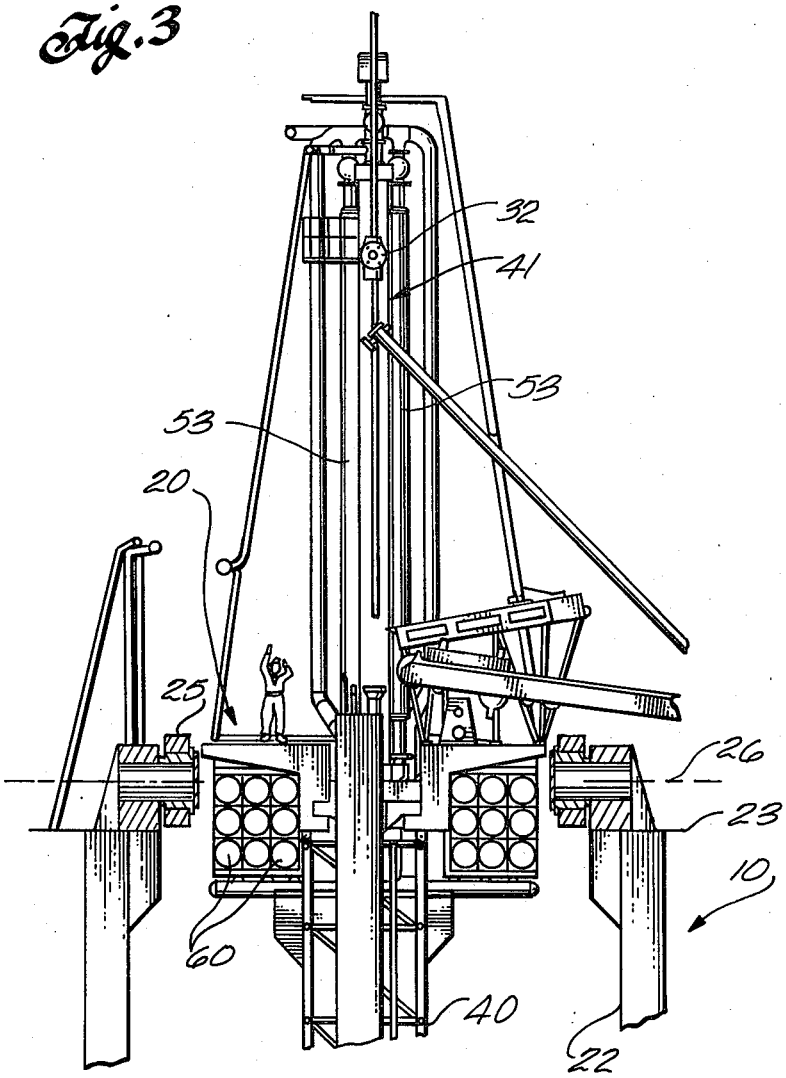
FIG. 3 is an elevation view taken along lines 3—3 in FIG. 2.

FIGS. 2 and 3 illustrate the presently preferred embodiment for the practice of this invention. In this embodiment, platform 20 is supported at or above drill ship main deck 23 on gimbals having transverse and longitudinal horizontal axes disposed at right angles to each other so that the drilling platform maintains an essentially horizontal state despite rolling and pitching angular motions of drill ship 10 in response to passing waves and the like. Thus, a gimbal ring 25 is supported in suitable bearings mounted to the vessel hull so that the ring is rotatable about a longitudinal gimbal axis 26 shown in FIG. 3. The gimbal ring, in turn, carries a pair of bearings 27 at spaced locations along a transverse gimbal axis 28 (see FIG. 2) which cooperate with suitable gimbal stub shafts carried by platform 20. Gimbal axis 28 extends transversely of the drill ship and, like gimbal axis 26, is substantially horizontal relative to the drill ship but is at right angles to gimbal axis 26.

Derrick 21 preferably is carried by the gimballed platform 20. The drilling platform has a principal working level 29 in which is mounted a suitable rotary table (not shown) for rotating a drill string about a substantially vertical line 30 along which riser 16 is movable toward and away from its connection with the wellhead assembly shown in FIG. 1. During actual drilling operations, the drill string is suspended in the derrick by a traveling block 32. The traveling block is supported in the derrick by wire rope cables connected to a suitable drawworks (not shown) which preferably is also mounted on the drilling platform. The traveling block moves up and down along line 30. It is preferred that the center of gravity of the drilling platform and the structure carried by it be located below the point of intersection of gimbal axes 26 and 28. In this way the drilling platform maintains a stable horizontal position despite rolling and pitching motions of the drill ship.

The drill string handling mechanisms provided on or in association with drilling platform 20 are not a part of this invention and therefore are not shown in the accompanying drawings or described in detail herein. The novel aspects of the arrangement shown in FIGS. 2 and 3 are encountered in the mechanism and procedure for handling and tensioning riser 16.

Riser 16 is composed of a series of individual lengths of large diameter tubular pipe, two of such lengths being shown at 34 and 35 in FIG. 2. A coupling 36 connects these adjacent components of the riser. Each coupling 36 preferably is a threaded pin and box joint composed of an externally threaded pin on the lower end of riser length 35, and an internally threaded cooperating box defined at the upper end of riser length 34.

The improved riser handling and tensioning mechanism preferably includes a stationary riser handling yoke 38 which is selectively operable to be releasably engageable with the exterior of the riser at any of the riser length box constructions. For example, yoke 38 may cooperate with suitable details defined by the upper exterior portions of each box construction. Stationary yoke 38, if desired, may be in general accord with the disclosures of U.S. Pat. No. 3,939,991. The stationary yoke is used only during the course of assembling or disassembling riser 16 and of raising or lowering the riser along drill line 30 from or into connection of the lower end of the riser with blowout preventer assembly 17.

During those periods in which the stationary yoke is actually used, it is used in conjunction with a traveling yoke 39 which is located below the stationary yoke in a substructure 40. Substructure 40 extends downwardly from the drilling platform within drill well 22 along drill line 30. The traveling yoke is supported in the gimballed structure by a pair of vertically disposed hydraulic rams 41 disposed on opposite sides of drill line 30. Each hydraulic ram 41 consists of an elongate vertically disposed cylinder 42, which preferably is located above the platform working level, and a piston rod 43. The traveling yoke is connected between the lower ends of the piston rods as shown in FIG. 2. The traveling yoke includes an openable collar 44 which when closed is engageable with the box portion of a joint between adjacent lengths of riser 16 for supporting the riser from downward motion through the traveling yoke. On the other hand when collar 44 is opened, a riser joint 36 can pass through the collar and through the traveling yoke. The stationary yoke is similarly openable and closeable relative to a riser joint to enable an assembled joint to pass through the stationary yoke.

The vertical travel of the stationary yoke along drill line 30 is somewhat greater than the length along riser 16 between adjacent interlength joints 36. The individual lengths 34, 35, etc. of riser 16 may have an axial extent of as much as 30 feet. It is therefore apparent that hydraulic rams 41 are of substantial size and afford substantial travel to traveling yoke 39. The rams are also of massive dimensions to enable the rams, as will be shown below, to support the entire weight of the assembled riser and to maintain the assembled riser under desired levels of tension during use; these tensions levels are greater than the immersed deadweight of the riser assembly. In a presently preferred arrangement according to this invention, rams 41 are each rated at 1 to 3 million pounds.

Rams 41 have active and passive operating modes. The rams are operated in their active mode during the course of assembling, and lowering or raising and disassembling riser 16. To assemble and lower riser 16 from drill ship 10 into engagement with blowout preventer 17, the upper end of the uppermost riser length is held in fixed yoke 38 while the next length of riser to be added is lowered along a drill line 30 by traveling block 32. The connection between the added and uppermost riser lengths is completed and the traveling yoke is raised into close association with the fixed yoke to engage the riser at the same riser joint with which the stationary yoke is engaged. Collar 44 is then closed about the riser and the stationary yoke is then opened so that the weight of the riser is transferred to the traveling yoke. The traveling yoke is then lowered, by operation of rams 41 in their lifting or active mode, to lower the riser one length along drill line 30 to bring the box construction at upper end of the added riser length into association with the stationary yoke. The stationary yoke is then closed to take the weight of the riser as collar 44 is opened to enable return of the traveling yoke to its uppermost position. Stationary yoke 38 and collar 44 are arranged to engage different portions of the upper end of a riser length so that, when the traveling yoke is at its uppermost position relative to the stationary yoke, both the stationary yoke and the collar can engage the riser in a load bearing manner. Because of the effects of gravity, rams 41 can be and preferably are single acting rams.

As riser 16 is made up and lowered in the manner described above, with BOP 17 carried by the lower end of the riser, continuous hoses for the BOP choke and kill lines are connected to the BOP and to the riser at intervals along the riser. The choke and kill line hoses may be drawn from suitable storage reels on drill ship 10. The connections of the hoses to the exterior of the riser may be made by suitable straps and the like. This treatment of the BOP choke and kill lines is to be contrasted from present deep water riser concepts which call for the choke and kill lines to be made integral with the riser sections which are stabbed rather than threaded together. Risers having integral choke and kill lines are expensive and require great care in handling and assembly.

Figure 4:
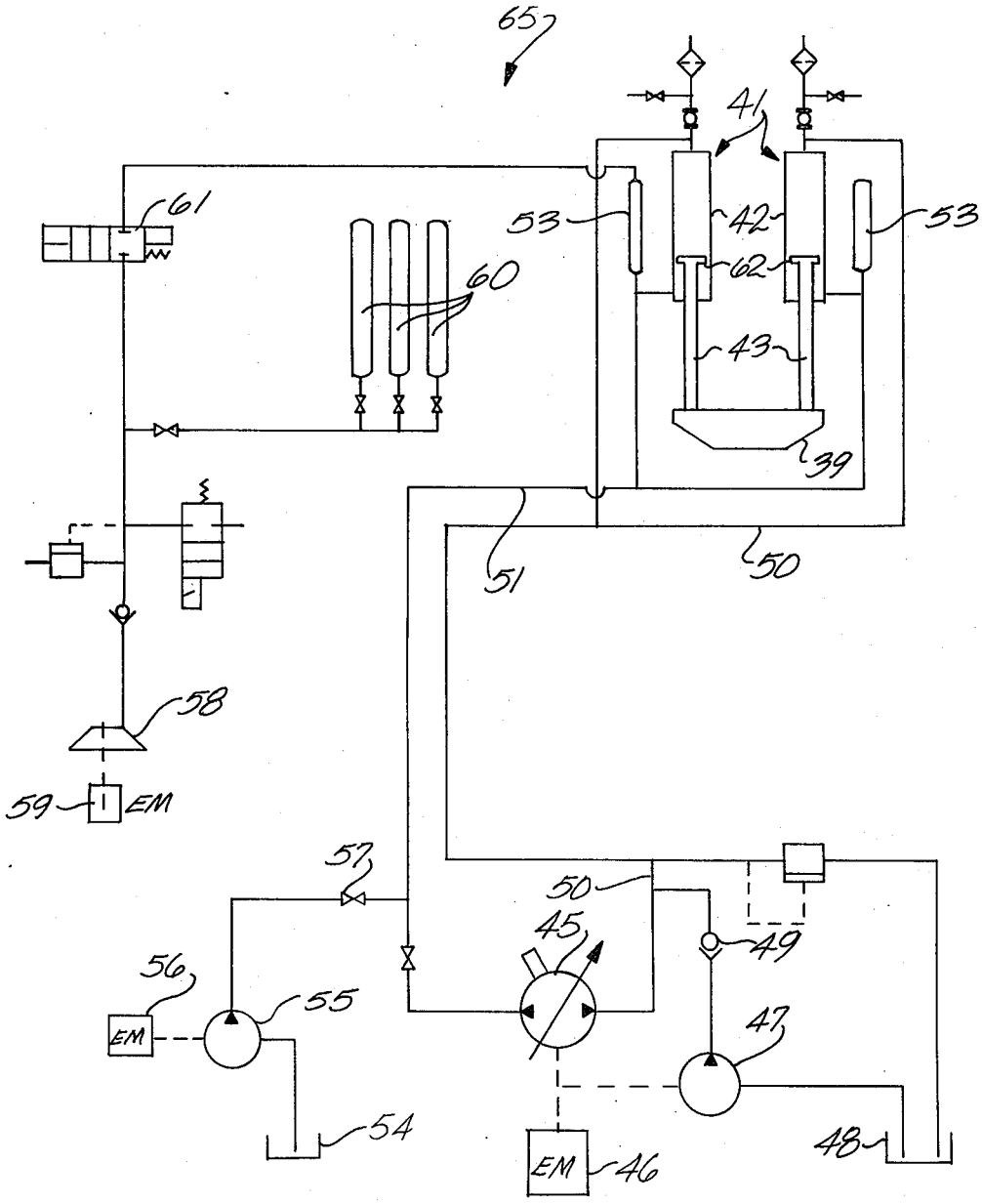
FIG. 4 is simplified schematic diagram of the hydraulic and pneumatic power and control system for the riser handling and tensioning means provided on the drill ship.

FIG. 4 is a simplified schematic diagram of a pneumohydraulic system 65 for operating and controlling rams 41. The hydraulic aspect of the system includes a reversible variable displacement pump 45 driven by an electric motor 46. Motor 46 also drives a heavy-lift make-up pump 47 operable for taking hydraulic fluid from a reservoir 48 and injecting it via check valve 49 into a hydraulic flow line 50 to which one of the ports of pump 45 is connected. Pump 47 is used for hydraulic fluid make-up when rams 41 are being operated in their heavy-lift riser handling active mode. Line 50 is connected to the upper ends of hydraulic cylinders 42. The other port of pump 45 is connected to a hydraulic line 51 which is connected to the lower ends of cylinders 42 and to the hydraulic connections of a pair of pneumo-hydraulic accumulators 53. One accumulator is provided for each of rams 41. A heave compensation hydraulic fluid make-up pump unit, composed of a separate hydraulic fluid reservoir 54 and a hydraulic pump 55 driven by an electric motor 56, is connected to hydraulic line 51 via a shut-off valve 57. Pump 55 is used for hydraulic fluid make-up when rams 41 are being operated in their passive heave compensating and riser tensioning mode. The pneumatic connections of accumulators 53 are connected to the output of a compressor 58 which is driven by an electric motor 59, and also to a bank of compressed air storage bottles 60. Compressor 58 and bottle bank 60 are connected to the accumulators via an air isolation valve 61. Compressor 58 is operable to charge the bottle bank to a selected air pressure, which pressure is selected to be greater by a desired amount than the level of the upwardly directed tensile load which is applied to riser 16 when rams 41 are operated in their passive heave compensating and riser tensioning mode.

When the riser handling mechanism is operated in its active heavy-lifting riser handling mode, hydraulic fluid is applied to or withdrawn from the lower portions of ram cylinders 42 by operating pump 45 in one direction or the other. During this mode of ram operation, the pneumatic aspects of systems 65 are disabled by closure of valve 61. However, when the lower end of a riser being lowered from drill ship 10 approaches the blowout preventer, the rams are shifted from their active mode to their passive heave-compensating and riser tensioning mode so that the position of BOP 17, carried by the lower end of riser 16, relative to the coupling by which it engages wellhead 19, can be precisely controlled despite vertical heaving motion of the drill ship in response to passing waves. In this manner, the lower end of the riser and BOP is moved into its coupling with the wellhead free of vertical oscillations due to heave of the drill ship. The connection of the BOP to the wellhead is made smoothly and without risk of damage either to the riser, the blowout preventer, or the wellhead.

Once the BOP has been connected to the wellhead, rams 41 are operated, in their passive mode, to establish and to maintain in the riser a selected upward tensile load in the riser. This tensile load prevents the riser from buckling of its own weight and causes it to stay as closely as possible in alignment with drill line 30. The magnitude of the tensioning load applied to the riser by the rams is a function of the effective area of the lower faces of pistons 62 in cylinders 42 to which piston rods 43 are connected, and also of the pressure applied to the hydraulic fluid in the lower portions of the cylinders by air bottle bank 60 via accumulators 53. This upward riser tensioning load is applied to the riser at a constant level despite vertical heaving motion of the vessel because rams 41 also then serve as heave compensators in the connection between the vertically fixed riser and the vertically movable drill ship. The riser tensioning load is applied to the riser by engagement of traveling yoke collar 44 with the riser, the stationary yoke being open at this time to enable the riser to move vertically relative to platform 29 along drill line 30.

The use of rams 41 for the multiple purposes of raising and lowering riser 16, for riser tensioning, and for heave compensation enables the elimination in drill ship 10 of conventional riser tensioning mechanisms which typically use wire ropes or the like. When the arrangement shown in the drawings and described above is used it is not necessary to periodically interrupt drilling operations to enable the wire rope cables of conventional riser tensioning arrangements to be renewed or replaced.

When rams 41 are operated in their passive riser tensioning and heave compensating mode, the upper ends of cylinders 41 are open to atmosphere to enable air to pass into and out of the cylinders 42 with each stroke of the pistons upwardly or downwardly in the cylinders. Any leakage of air or oil from the ram system is replaced at appropriate times by use of compressor 58, and by heave compensation make-up pump 55.

It will also be noted that riser 16 is coupled essentially directly to the drilling platform via the heave compensating rams 41, and that no telescopic slip joint is required in the connection of the riser per se to the drill ship. If desired, however, a telescoping slip joint can be incorporated in the riser adjacent its lower end to prevent buckling of the riser whenever, if ever, the riser tension might happen to be reduced to a point that heave motion could cause a buckling failure in the riser column. Under normal circumstances such a submerged slip joint would be maintained at its fully extended position by the tensioning load applied to the upper end of the riser by rams 41. If heave motions of the vessel are greater than the heave compensating capacity of rams 41, then the submerged slip joint would assume an intermediate position in its stroke, in which event the portion of the riser above the slip joint would still be maintained in tension by reason of its own deadweight and its pendulous support from traveling yoke 39. If desired, more than one submerged slip joint may be used to provide sufficient stroke, and these submerged units can be placed in the riser at different points to minimize the effect of bending loads upon their operation. The submerged telescoping slip joints described above, if provided, are functionally independent of the hydraulic lift and heave compensator system centered on rams 41.

It is preferred that the strokes of piston rods 43 be synchronized to keep the alignment of the traveling yoke axis and the riser axis in line within specified limits and to minimize the application of bending loads to the riser by the traveling yoke. The synchronizing mechanism may be provided in the form of parallel torsion shafts aligned along opposite sides of the traveling yoke, each carrying a gear at each end. The gears on the torsion shafts are engageable with racks carried by the platform substructure 40. Torque generated in the torque shafts by an out-of-synchronism condition in the rams will produce opposing forces in the cylinder rods which, in combination with pressure equalizing lines between cylinders 42, enable the hydraulic system to adjust to these opposing forces in such a way as to bring the pistons back into synchronism.

If desired, the operation of rams 41, during their use for riser tensioning and heave compensating as described above, may be modified by the active heave compensator control system described in commonly owned U.S. Pat. No. 3,905,580.

It will therefore be appreciated that several significant advantages follow from the multiple functions of rams 41. As noted, no slip joint is required between the upper end of the riser and the drilling platform as would be the case in the typical drilling floating platform. Also, because of the massiveness and great load-carrying capacity of rams 41, the riser assembly can be defined of relatively simple tubular steel elements. No external buoyancy elements are used in connection with riser assembly 16. As noted above, external buoyancy elements increase the overall diameter of the riser sections and make handling of those sections much more difficult and time consuming. Because no such buoyancy elements are used with the sections of riser 16, the riser sections have minimum outer diameter which is determined solely with reference to the strength of the riser assembly needed for a particular water depth. The typical wire rope riser tensioning mechanisms are eliminated. The overall effect is that the drill ship can function much more efficiently for its intended purpose, i.e., the drilling of submarine oil or gas wells. The riser assembly can be installed very quickly and safely, thereby enabling the drill ship to commence and complete drilling operations more promptly after arrival over the well site.

Persons skilled in the art to which this invention pertains will appreciate that the preceding description has been presented with reference, principally, to only a single embodiment of the invention as illustrated in the accompanying drawings. The described embodiment is the embodiment of the invention which is presently preferred. It will be understood, however, that the present invention can be manifested in embodiments different from the described presently preferred embodiment. The preceding description sets forth the presently known best mode of practicing this invention, but certainly not all possible modes. Accordingly, workers skilled in the art to which this invention pertains will readily appreciate that modifications, alterations or variations in the arrangements and procedures described above may be practiced without departing from, and while still relying upon, the essential aspects of this invention.

What is claimed is:

1. Apparatus useful in drilling a well at a location submerged below a body of water comprising a buoyant foundation structure floatable on the surface of the body of water and subject to vertical motion in response to waves and the like, handling and tensioning means for moving a riser pipe along a substantially vertical line from and to the foundation structure into and out of connection of the lower end of the riser pipe with the submerged location and for applying tension to a riser pipe connected to the submerged location, the handling and tensioning means including vertically disposed hydraulic ram means mounted to the foundation structure at a location fixed vertically relative to the foundation structure, holding means releasably engageable with a riser pipe adjacent the upper end thereof and connected to the ram means for movement along said line in response to operation of the ram means, the ram means having an active first operating mode in which it is operable to lower and raise a riser pipe along said line into and out of said connection to the submerged location and a second operating mode in which it is operable during vertical motion of the foundation structure to apply a selected upward force to a riser engaged by the holding means and connected to the submerged location.

2. Apparatus according to claim 1 including power and control means for the ram means including means operable for actively operating the ram means to raise and to lower a riser along the line, pneumo-hydraulic accumulator means selectively connectible in operative relation to the ram means, a compressed air reservoir connectible to the accumulator means, and means for establishing a desired air pressure in the reservoir.

3. Apparatus according to claim 1 wherein the ram means comprises a pair of rams located on opposite sides of the line and having vertically fixed cylinders and piston rods extending downwardly therefrom parallel to said line, and wherein the holding means is connected between the lower ends of the piston rods.

4. Apparatus according to claim 3 wherein the riser is composed of a plurality of substantially identical riser sections connected together at a plurality of couplings spaced substantially equally along the riser, and the holding means is engageable with the riser at any of the couplings.

5. Apparatus according to claim 4 wherein the couplings are threaded couplings.

6. Apparatus according to claim 4 including a second holding means releasably engageable with a riser and disposed at a fixed location along said line at a position above the first holding means.

7. apparatus according to claim 6 wherein the ram means are operable for moving the first holding means along said line from an upper position thereof proximately adjacent the second holding means to a lower position thereof spaced along the line from the upper position by an amount corresponding to the length of one of said riser sections.

8. Apparatus according to claim 7 wherein the first and second holding means are cooperatively configured and arranged for engaging the riser at the same coupling when the first holding means is disposed at its upper position along the line.

9. Apparatus according to claim 8 including a platform on the structure over a passage vertically through the structure, and wherein the rams are mounted to the platform.

10. Apparatus according to claim 9 including gimbal means mounting the platform to the structure.

11. Apparatus according to claim 1 including second holding means fixed along the line above the first holding means and releasably engageable with a riser for holding the riser from movement downwardly along the line.

12. Apparatus according to claim 11 wherein the first and second holding means are arranged for engaging the riser at substantially the same location on the riser.

13. A method for handling riser pipe in establishing and drilling a well at a location submerged below a body of water comprising (a) providing a buoyant floatable foundation structure, (b) locating on the foundation structure at a position which is fixed vertically relative thereto means for raising and lowering a riser along a vertical line, said means including a vertically acting hydraulic ram and a riser holder connected to the ram, (c) making up a riser pipe and lowering it from the foundation structure toward the submerged location by a procedure which includes actively operating the ram to lower the riser pipe into connection of the lower end of the riser pipe with the submerged location, and (d) after connection of the lower end of the riser pipe to the submerged location, operating the ram to apply a selected upward force to the upper end of the riser pipe sufficient to maintain the riser pipe in tension along its length and to isolate the upper end of the riser pipe from vertical motion of the foundation structure as in response to waves and the like.

14. A method according to claim 13 wherein the ram includes a piston movable in a vertically disposed cylinder, and the step of operating the ram to apply a selected upward force includes effectively coupling to the cylinder below the piston a pneumo-hydraulic accumulator, effectively coupling to the accumulator a compressed air reservoir charged with compressed air at a pressure correlated to said selected upward force, and venting to atmosphere the cylinder above the ram, whereby the reservoir air pressure establishes the selected force and maintains it on the piston during motion of the piston in the cylinder.

15. A method according to claim 13 including locating in fixed relation to the foundation structure along the line a second riser holder which is releasably engageable with a riser for holding the riser from movement downwardly along the line, and wherein the riser lowering step includes engaging the second holder with a riser at a first selected location therealong, operating the ram to move the first holder to an upper position thereof along the line and engaging the riser at a second selected location therealong, releasing the second holder from the riser so that the riser is supported entirely by the first holder, operating the ram to move the first holder to a lower position thereof along the line, engaging the second holder with the riser at a third selected location therealong, and releasing the first holder from the riser.

16. A method according to claim 15 wherein the first and second selected locations along the riser are at substantially the same location along the riser.

17. Apparatus useful in drilling a well at a location submerged below a body of water comprising a buoyant foundation structure floatable on the surface of the body of water and subject to vertical motion in response to waves and the like, handling and tensioning means for moving a riser pipe along a substantially vertical line from and to the foundation structure into and out of connection of the lower end of the riser pipe with the submerged location and for applying tension to a riser pipe connected to the submerged location, and handling and tensioning means including vertically disposed hydraulic ram means mounted to the foundation structure, holding means releasably engageable with a riser pipe adjacent the upper end thereof and connected to the ram means for movement along said line in response to operation of the ram means, the ram means having an active first operating mode in which it is operable to lower and raise a riser pipe along said line into and out of said connection to the submerged location and a second operating mode in which it is operable to apply a selected upward force to a riser engaged by the holding means and connected to the submerged location during vertical motion of the foundation structure, and power and control means for the ram including means operable for actively operating the ram means to raise and to lower a riser along the line, pneumo-hydraulic accumulator means selectively connectible in operative relation to the ram means, a compressed air reservoir connectible to the accumulators, and means for establishing a desired air pressure in the reservoir.

18. A method for handling riser pipe in establishing and drilling a well at a location submerged below a body of water comprising (a) providing a buoyant floatable foundation structure, (b) locating on the foundation structure means for raising and lowering a riser along a vertical line, said means including a vertically acting hydraulic ram including a piston movable in a vertically disposed cylinder and a riser holder connected to the cylinder, (c) making up a riser pipe and lowering it from the foundation structure toward the submerged location by a procedure which includes actively operating the ram to lower the riser pipe into connection of the lower end of the riser pipe with the submerged location, and (d) after connection of the lower end of the riser pipe to the submerged location, operating the ram to apply a selected upward force to the upper end of the riser pipe sufficient to maintain the riser pipe in tension along its length even during vertical motion of the foundation structure as in response to waves and the like, the step of operating the ram including effectively coupling the cylinder below the piston to a pneumo-hydraulic accumulator, effectively coupling to the accumulator a compressed air reservoir charged with compressed air at a pressure correlated to said selected upward force, and venting to atmosphere the cylinder above the ram, whereby the reservoir air pressure establishes the selected force and maintains it on the piston during motion of the piston in the cylinder.

* * * * *